US011029008B2

(12) United States Patent
Boomgaarden

(10) Patent No.: US 11,029,008 B2
(45) Date of Patent: Jun. 8, 2021

(54) LIGHTING FIXTURE INCLUDING A COLOR CHANGING COMPONENT

(71) Applicant: IDEAL Industries Lighting LLC, Sycamore, IL (US)

(72) Inventor: Mark Boomgaarden, Cary, NC (US)

(73) Assignee: IDEAL Industries Lighting LLC, Racine, WI (US)

( * ) Notice: Subject to any disclaimer, the term of this patent is extended or adjusted under 35 U.S.C. 154(b) by 0 days.

(21) Appl. No.: 16/667,115

(22) Filed: Oct. 29, 2019

(65) Prior Publication Data

US 2021/0123589 A1 Apr. 29, 2021

(51) Int. Cl.

| | |
|---|---|
| ***F21V 23/00*** | (2015.01) |
| ***F21V 23/04*** | (2006.01) |
| ***F21V 9/40*** | (2018.01) |
| ***F21V 3/04*** | (2018.01) |

(52) U.S. Cl.

CPC ..... *F21V 23/003* (2013.01); *F21V 3/049* (2013.01); *F21V 9/40* (2018.02); *F21V 23/0442* (2013.01)

(58) Field of Classification Search

None

See application file for complete search history.

(56) References Cited

U.S. PATENT DOCUMENTS

| | | | | |
|---|---|---|---|---|
| 10,465,869 | B2 | 11/2019 | Keller et al. | |
| 2015/0338062 | A1* | 11/2015 | Lee | F21K 9/60 362/293 |
| 2018/0252374 | A1 | 9/2018 | Keller et al. | |

FOREIGN PATENT DOCUMENTS

| | | | | |
|---|---|---|---|---|
| CN | 204189391 | U | | 3/2015 |
| CN | 207302551 | U | * | 5/2018 |
| JP | 355108476 | U | | 7/1980 |
| KR | 20180001022 | A | | 1/2018 |
| WO | 2014150654 | A1 | | 9/2014 |

OTHER PUBLICATIONS

Plastics Technology "New Acrylic Sheet Is Black by Day, White by Night" (Year: 1997).*

Author Unknown, "Acrylite® LED color changing back lit black / white 9K004 GT," accessed Jan. 23, 2019 from https://www.acrylite.co/led-color-changing-back-lit-black-and-white-9k004-gt.html, Röhm GmbH, 3 pages.

International Search Report and Written Opinion for International Patent Application No. PCT/US2020/057744, dated Feb. 10, 2021, 15 pages.

* cited by examiner

*Primary Examiner* — Britt D Hanley

(74) *Attorney, Agent, or Firm* — Withrow & Terranova, P.L.L.C.

(57) ABSTRACT

A lighting fixture includes a housing, a light source, and a diffuser. The light source is mounted in the housing. The diffuser is also mounted in the housing such that light emitted from the light source is provided through the diffuser towards an area of interest. The diffuser is configured such that a color of the diffuser is based on one or more characteristics of the light emitted from the light source. Providing the diffuser such that the color thereof is based on one or more characteristics of the light emitted from the light source allows the aesthetic appearance of the lighting fixture to be changed. Further, it allows the lighting fixture to better simulate outdoor environments. Finally, it allows the lighting fixture to convey information to individuals near the lighting fixture without being disruptive.

20 Claims, 10 Drawing Sheets

LIGHTING FIXTURE INCLUDING A COLOR CHANGING COMPONENT

FIELD OF THE DISCLOSURE

The present disclosure is related to lighting fixtures, and in particular to lighting fixtures including a color changing component that may be used to improve the aesthetics of the lighting fixtures, simulate an outdoor environment, and/or convey information from the lighting fixtures.

BACKGROUND

Modern lighting devices such as lighting fixtures may include intelligent features such as network connectivity, programming capability, detection of environmental conditions via a number of sensors, and the like. However, there has thus far been a limitation in lighting fixtures in their ability to convey information to a person in the vicinity thereof. While previous approaches have focused on changing a characteristic (e.g., color) of light provided from a lighting fixture to convey information, these approaches have been significantly disruptive in terms of the effect they have on individuals near the lighting fixture. For example, if a lighting fixture were to change the color of the light provided therefrom from typical white to red to convey some kind of information, such a drastic change in the color of the light may be highly disruptive to individuals near the lighting fixture and may thus cause interruptions in the activities of these individuals. Similarly, flashing the light from a lighting fixture to convey information is also disruptive in many circumstances. Accordingly, there is a need for lighting fixtures and methods for operating the lighting fixtures in order to convey information without disruption to individuals surrounding the lighting fixtures.

In addition to the above, there has been recent work on lighting fixtures that simulate outdoor environments. Simulating outdoor environments using lighting fixtures may provide certain health benefits and improvements in the mood of individuals in an indoor space. However, current lighting fixtures have difficulty simulating a full range of outdoor conditions such as overhead clouds and night skies. Accordingly, there is a need for lighting fixtures and methods for operating the lighting fixtures in order to more accurately simulate outdoor environments.

SUMMARY

In one embodiment, a lighting fixture includes a housing, a light source, and a diffuser. The light source is mounted in the housing. The diffuser is also mounted in the housing such that light emitted from the light source is provided through the diffuser towards an area of interest. The diffuser is configured such that a color of the diffuser is based on one or more characteristics of the light emitted from the light source. Providing the diffuser such that the color thereof is based on one or more characteristics of the light emitted from the light source allows the aesthetic appearance of the lighting fixture to be changed. Further, it allows the lighting fixture to better simulate outdoor environments. Finally, it allows the lighting fixture to convey information to individuals near the lighting fixture without being disruptive.

In one embodiment, the lighting fixture includes an additional light source and control circuitry. The control circuitry is coupled to the light source and the additional light source and configured to individually adjust one or more characteristics of the light provided by the light source and the additional light source. In one embodiment, the control circuitry is configured to adjust one or more characteristics of the light provided by the light source in order to change a color of the diffuser and adjust one or more characteristics of the light provided by the additional light source such that one or more characteristics of a combination of the light provided by the light source and the light provided from the additional light source remain constant. Accordingly, the color of the diffuser can be changed to change an aesthetic appearance of the lighting fixture, simulate an outdoor environment, or convey information while simultaneously providing light suitable for general illumination.

In one embodiment, a method includes the steps of providing light from a light source through a diffuser towards an area of interest and changing one or more characteristics of the light provided from the light source in order to change a color of the diffuser. The method may further include providing light from an additional light source towards the area of interest and changing one or more characteristics of the light provided by the additional light source to offset the change in the one or more characteristics of the light source such that one or more characteristics of a combination of the light provided by the light source and the light provided by the additional light source remains constant. This method allows for the adjustment of the color of the diffuser to change an aesthetic appearance of a lighting fixture, simulate an outdoor environment, or convey information while simultaneously providing light suitable for general illumination.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
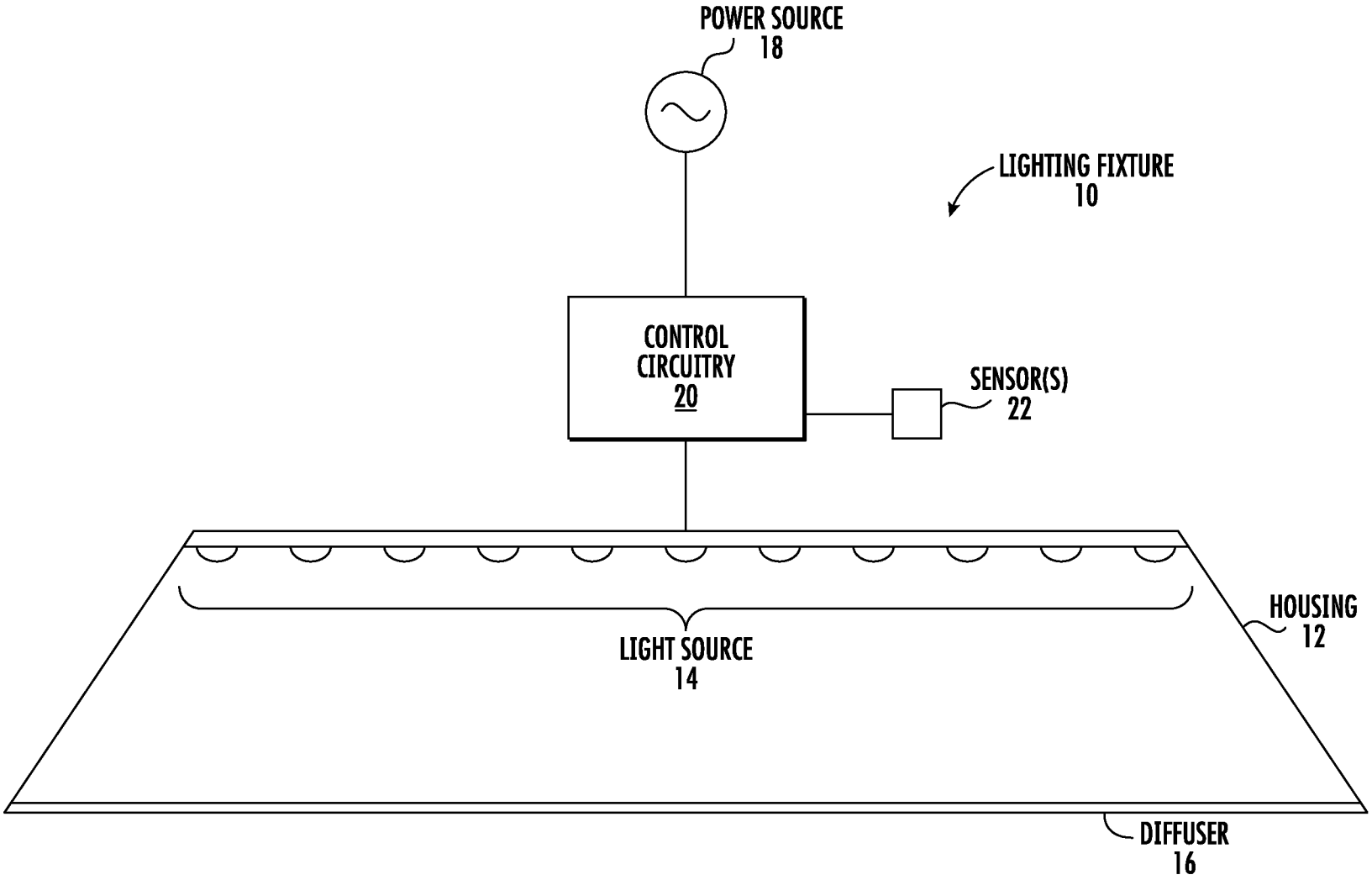
FIG. 1 illustrates a lighting fixture according to one embodiment of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

FIG. 1 shows a lighting fixture 10 according to one embodiment of the present disclosure. The lighting fixture 10 includes a housing 12, a light source 14 in the housing 12, a diffuser 16 in the housing 12, a power source 18, and control circuitry 20 coupled between the power source 18 and the light source 14. In some embodiments, the lighting fixture 10 may further include a number of sensors 22, which are coupled to the control circuitry 20 and provide sensor data thereto. In operation, the control circuitry 20 receives power from the power source 18 and provides one or more drive signals to control light emitted from the light source 14. In particular, the control circuitry 20 may provide drive signals such that one or more characteristics of light emitted from the light source 14 are precisely controlled. For example, the control circuitry 20 may be capable of changing a brightness, color temperature, color rendering index, color, or any other characteristic of the light provided from the light source 14. The control circuitry 20 may be further capable of communicating with remote devices such as other lighting fixtures or controls in order to change one or more characteristics of the light provided from the light source 14 in response to automation programs, user input, or the like. Light emitted from the light source 14 is provided towards an area of interest through the diffuser 16 such that some of the light emitted from the light source 14 is provided directly towards the area of interest and the remainder of the light emitted from the light source 14 is provided indirectly towards the area of interest as it is reflected one or more times within a mixing area within the housing 12 bounded by the diffuser 16.

Notably, the diffuser 16 comprises a color changing material such that when the diffuser 16 is primarily front-lit from a light source outside of the housing 12, the diffuser 16 appears to be a first color and when the diffuser is primarily back-lit from the light source 14 in the housing 12, the diffuser 16 appears to be a second color that is different from the first color. For example, the diffuser 16 may appear to be black or dark grey when it is primarily front-lit and appear to be white or light grey when it is primarily back-lit. The color of the diffuser 16 may not be binary, such that the color of the diffuser 16 may vary between the first color and the second color depending on the amount of front-lighting and back-lighting of the diffuser 16. Examples of the color changing material of the diffuser include Acrylite 9K004 GT, the datasheet of which is hereby incorporated by reference in its entirety, and Acrylite 9H04 SC, the datasheet of which is hereby incorporated by reference in its entirety. Those skilled in the art will appreciate that any number of materials may be used to provide the color changing effect of the diffuser 16, all of which are contemplated herein.

Using a color changing material for the diffuser 16 may provide several benefits. First, the aesthetic appearance of the lighting fixture 10 may be improved. Second, the diffuser 16 may allow the lighting fixture 10 to better simulate outdoor environments that were previously difficult to simulate using a lighting fixture 10, for example, overhead clouds and night skies. This may be especially useful, for example, in lighting fixtures that are configured to provide a simulated skylight experience such as the lighting fixtures described in co-assigned and co-pending U.S. patent application Ser. No. 15/972,176, now U.S. Pat. No. 10,465,869, the contents of which are hereby incorporated by reference in their entirety. Finally, the diffuser 16 may allow the lighting fixture 10 to convey information to individuals around the lighting fixture 10 without disrupting the individuals. That is, the diffuser 16 may allow the lighting fixture 10 to convey information to individuals around the lighting fixture 10 while continuing to provide light suitable for general illumination.

The light source 14 may be a solid-state light source including one or more light emitting diodes (LEDs). The one or more LEDs may be arranged in an array or in groups such that different ones of the LEDs provide different light output characteristics. The control circuitry 20 may control one or more characteristics of the light emitted from each one of the LEDs in order to provide a combined light output with desired characteristics. While shown having a particular shape for purposes of illustration, the housing 12 may comprise any suitable shape. For example, the housing 12 may be used to provide a troffer lighting fixture, a recessed lighting fixture, or any other desired lighting fixture.

Figure 2:
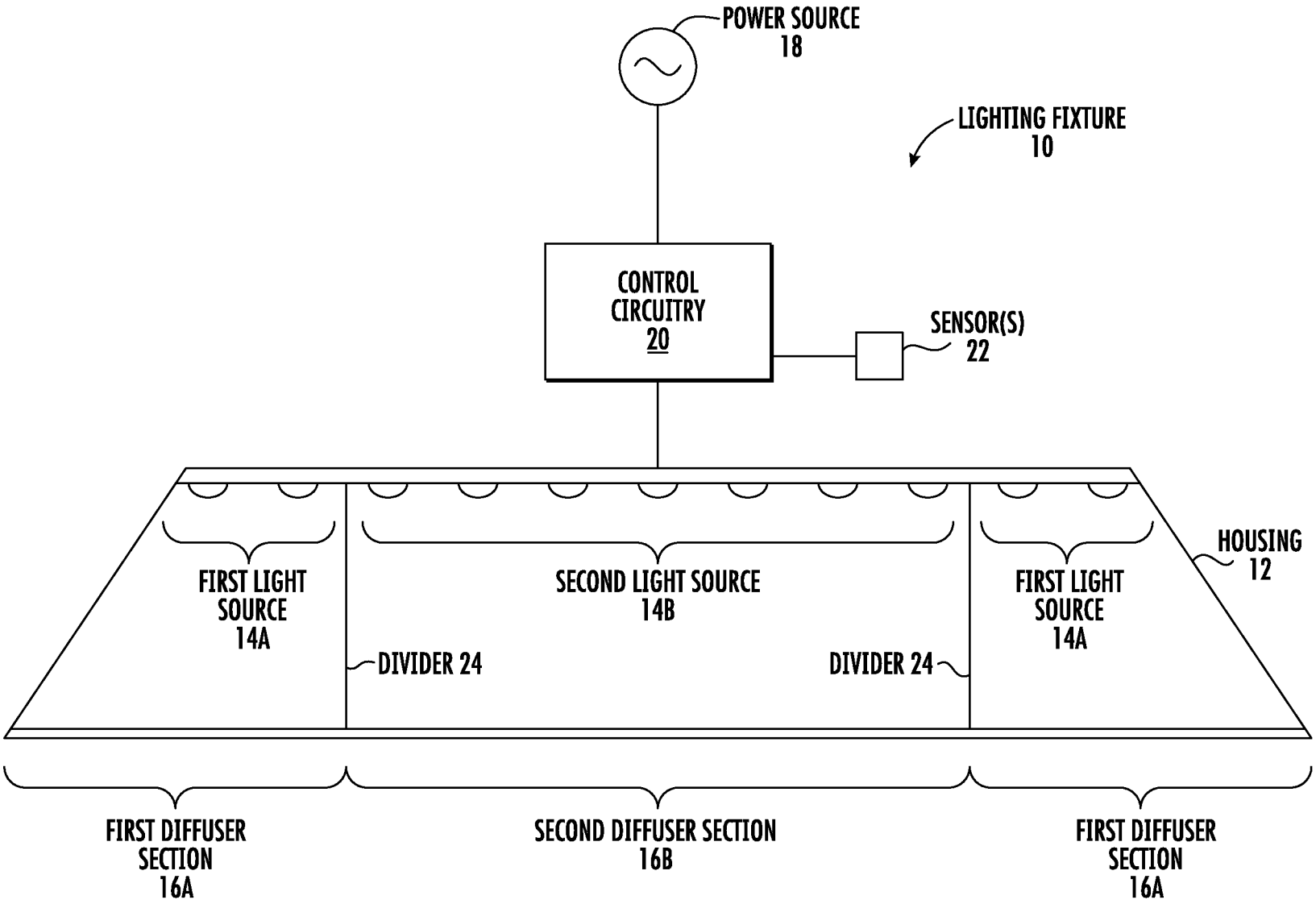
FIG. 2 illustrates a lighting fixture according to one embodiment of the present disclosure.

While the diffuser 16 is shown as a continuous sheet in the lighting fixture 10 depicted in FIG. 1, the diffuser 16 may be broken up into one or more sections such that only a portion of the diffuser 16 comprises a color changing material. For example, FIG. 2 shows the lighting fixture 10 in which the diffuser 16 is separated into a first diffuser section 16A and a second diffuser section 16B. The first diffuser section 16A may comprise a material that is not color changing. That is, the first diffuser section 16A may appear to be the same color regardless of whether it is primarily front-lit or back-lit. The second diffuser section 16B may comprise a color changing material as discussed above. In some embodiments, the light source 14 may include a first light source 14A and a second light source 14B. The first light source 14A may provide light towards the area of interest through the first diffuser section 16A, while the second light source 14B may provide light towards the area of interest through the second diffuser section 16B. To ensure that light from the first light source 14A is provided through the first diffuser section 16A and light from the second light source 14B is provided through the second diffuser section 16B, dividers 24 may be used to direct light from the first light source 14A through the first diffuser section 16A and from the second light source 14B through the second diffuser section 16B.

In some embodiments, the control circuitry 20 may be capable of independently controlling the first light source 14A and the second light source 14B. Breaking the diffuser 16 into the first diffuser section 16A and the second diffuser section 16B and independently controlling the light provided through the first diffuser section 16A and the second diffuser section 16B may allow the lighting fixture 10 to more easily continue to provide light suitable for general illumination while also conveying information to individuals around the lighting fixture 10 by changing the color of the second diffuser section 16B. For example, light for general illumination can be provided from the first light source 14A through the first diffuser section 16A, while the second light source 14B can be used to change the color of the second diffuser section 16B by changing one or more characteristics of the light emitted therefrom in order to convey information to individuals around the lighting fixture 10.

The control circuitry 20 may be configured to adjust one or more characteristics of light provided from the first light source 14A along with the one or more characteristics of the light provided from the second light source 14B in order to maintain one or more characteristics of the overall light provided by the first light source 14A and the second light source 14B within the area of interest at a constant level. For example, if a brightness of the light provided from the second light source 14B is reduced to darken the second diffuser section 16B in order to change the appearance of the lighting fixture 10 and/or convey information to individuals around the lighting fixture 10, a brightness of the light provided from the first light source 14A may be increased to compensate for the reduction in the light output from the second light source 14B and thus maintain the overall brightness of the light within the area of interest at a constant level. In this way, the appearance of the lighting fixture 10 can be changed for aesthetic purposes or to convey information while maintaining light suitable for general illumination and thus not disrupting individuals around the lighting fixture 10.

Figure 3:
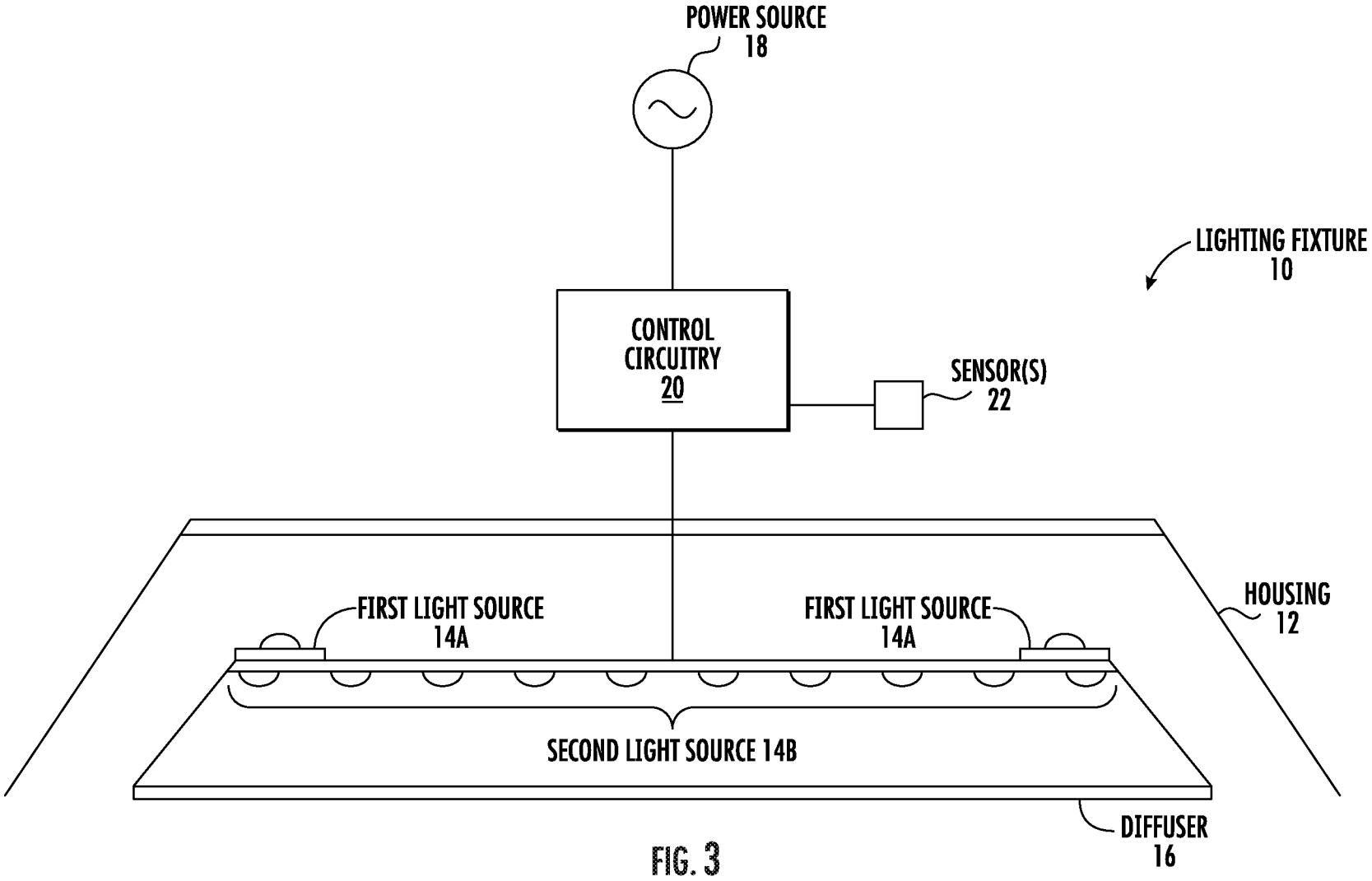
FIG. 3 illustrates a lighting fixture according to one embodiment of the present disclosure.

FIG. 3 shows the lighting fixture 10 according to an alternative embodiment of the present disclosure wherein the first light source 14A is arranged such that light provided therefrom is provided towards the area of interest indirectly instead of through the diffuser 16. In such an embodiment, the entirety of the diffuser 16 may comprise a color changing material as discussed above. FIG. 3 is provided to show that there are a number of different configurations for the light source 14 in the lighting fixture 10 in order to accomplish the objectives discussed herein. All of these configurations are contemplated by the present disclosure.

Figure 4:
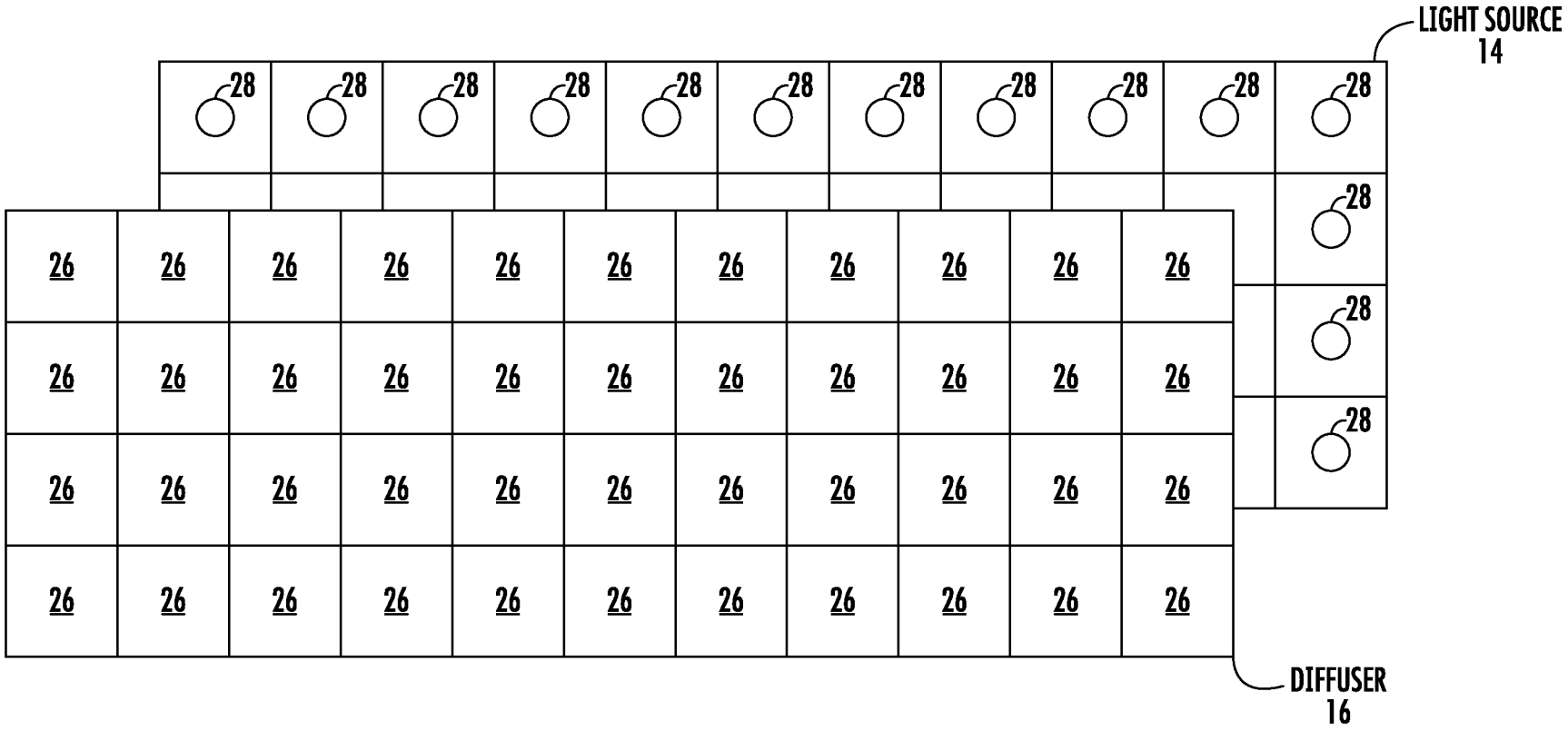
FIG. 4 illustrates a light source and a diffuser for a lighting fixture according to one embodiment of the present disclosure.
Figure 5:
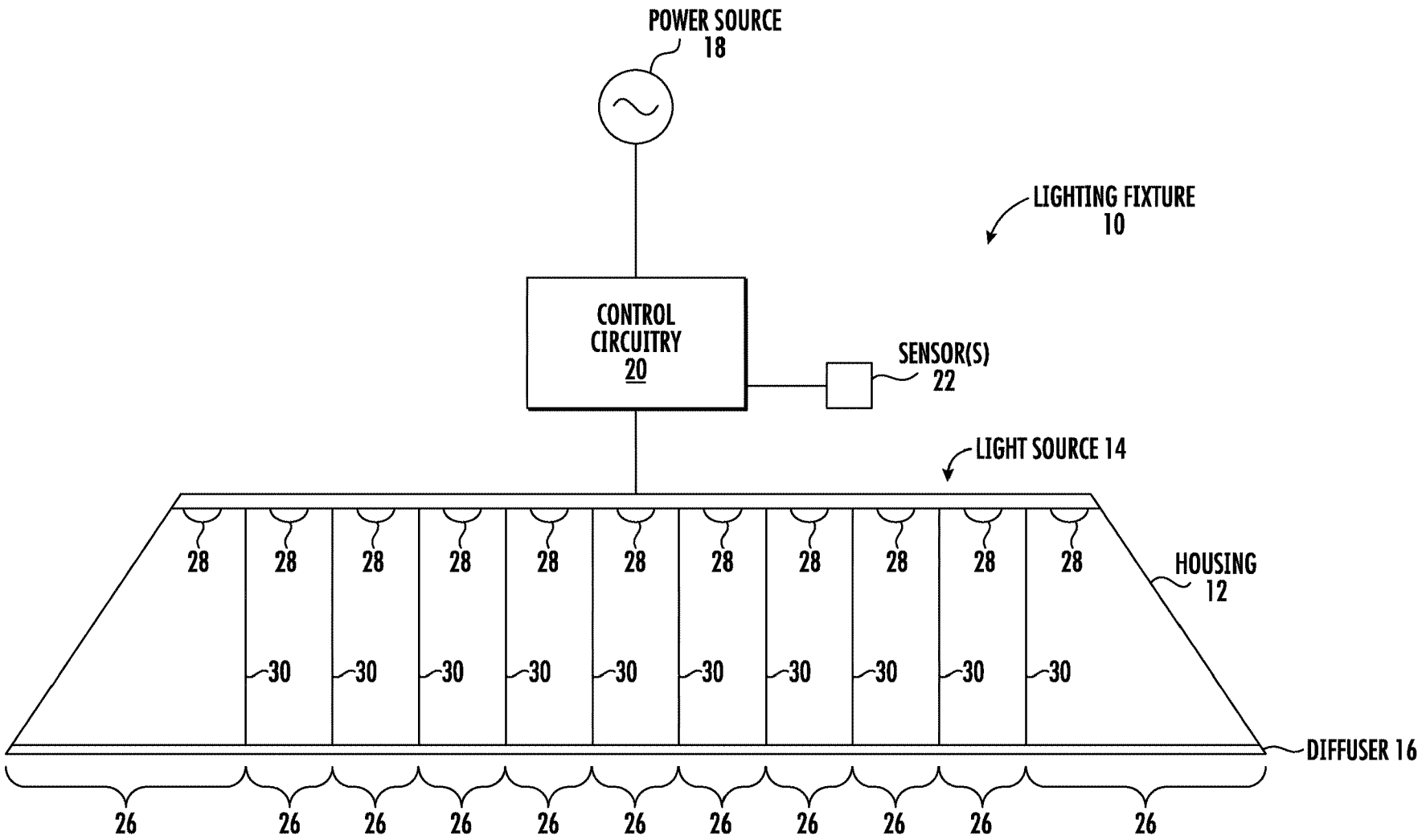
FIG. 5 illustrates a lighting fixture according to one embodiment of the present disclosure.

In some embodiments, the diffuser 16 may comprise an array of diffusers and the light source 14 may comprise an array of LEDs. Accordingly, FIG. 4 shows the diffuser 16 as an array of diffusers 26 and the light source 14 as an array of LEDs 28. In FIG. 4, each one of the array of LEDs 28 corresponds to one of the array of diffusers 26 (e.g., in a one-to-one relationship) such that light from the one of the array of LEDs 28 is provided through the one of the array of diffusers 26. In some embodiments, more than one of the array of LEDs 28 may correspond to each one of the array of diffusers 26 (e.g., in a many-to-one relationship). In general, FIG. 4 illustrates a relationship between LEDs 28 and diffusers 26 wherein light provided through each one of the array of diffusers 26 is individually controllable. This may be achievable, for example, using dividers 30 as shown in the lighting fixture 10 in FIG. 5, which shows the light source 14 including the array of LEDs 28 and the diffuser 16 as the array of diffusers 26. As shown, the dividers 30 channel light from each one of the array of LEDs 28 into a corresponding one of the array of diffusers 26. As discussed above, the control circuitry 20 may be configured to individually control one or more light output characteristics of the light provided by each one of the array of LEDs 28. Accordingly, the lighting fixture 10 may provide a low resolution display surface in which information can be conveyed by changing the color of a number of the array of diffusers 26 to provide a pattern, as illustrated in FIGS. 6A and 6B.

Figure 6A:
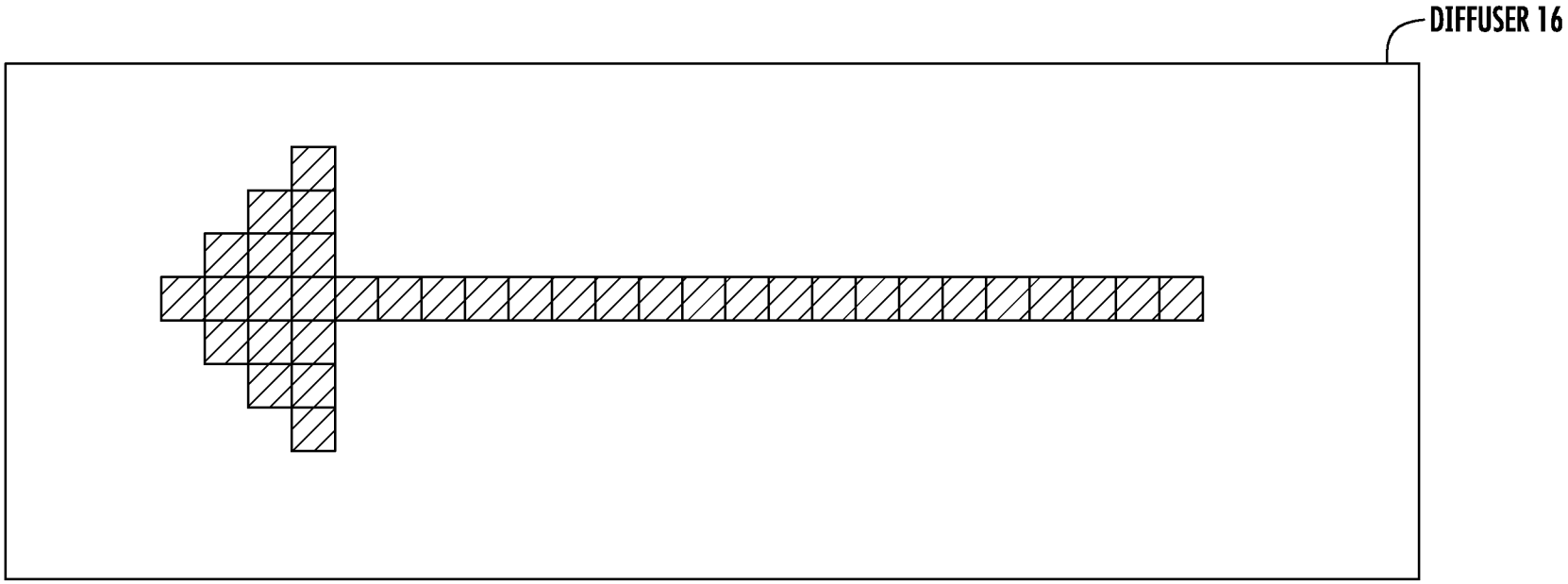
FIGS. 6A and 6B illustrate a diffuser for a lighting fixture according to one embodiment of the present disclosure.
Figure 6B:
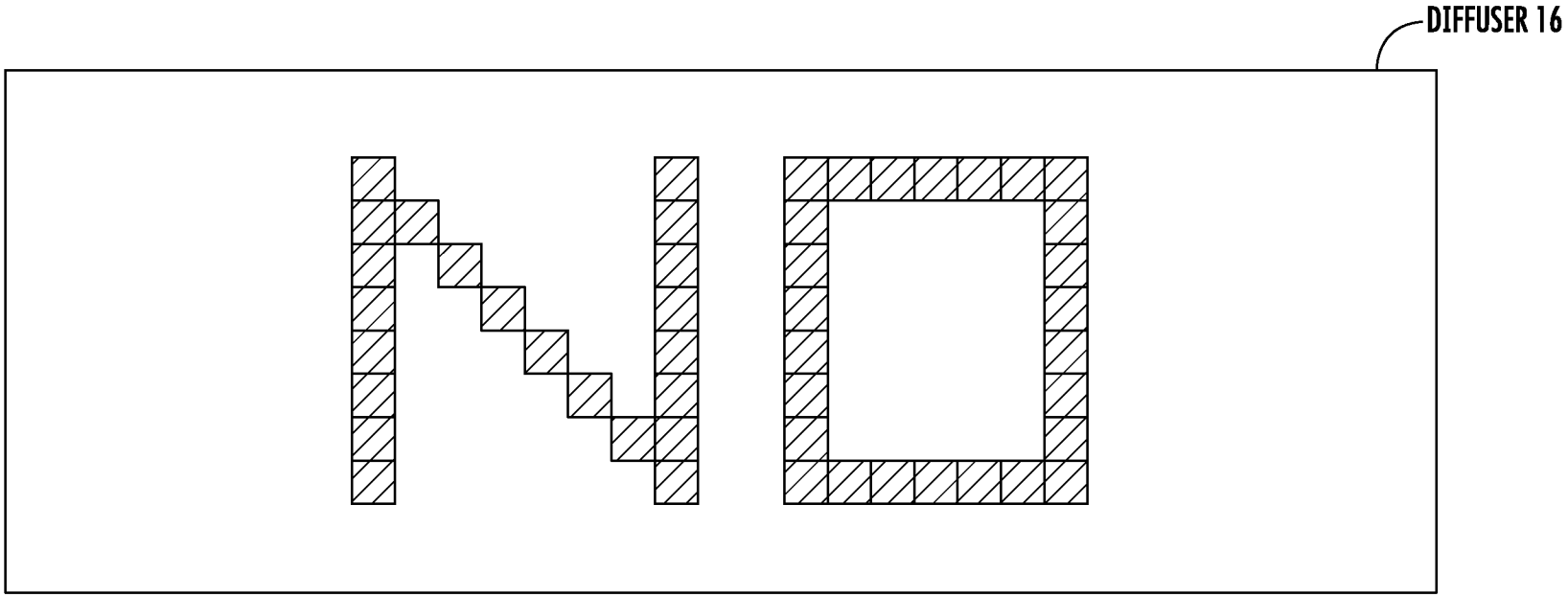

In particular, FIGS. 6A and 6B show a bottom-up view of the diffuser 16 and illustrate what is possible if the array of diffusers 26 includes a large number of diffusers 26 and the light provided through each one of the array of diffusers 26 is individually controllable. Patterns can be provided on the array of diffusers 26 that communicate information such as directions (FIG. 6A), the availability of a resource in the environment (FIG. 6B), or the like to individuals around the lighting fixture 10. As discussed above, one or more light output characteristics of each of the array of LEDs 28 can be adjusted both to change the color of various ones of the array of diffusers 26 as well as maintain one or more light output characteristics in the area of interest at a constant level. For example, while a brightness of the light provided from the ones of the array of LEDs 28 corresponding with the ones of the array of diffusers 26 that are shaded in FIGS. 6A and 6B may be reduced to darken these ones of the array of diffusers 26, a brightness of the light provided from one or more other LEDs 28 in the array of LEDs 28 may be increased to compensate for this reduction in brightness and thus maintain the overall brightness of the light provided by the lighting fixture 10 within the area of interest at a constant level.

Figure 7:
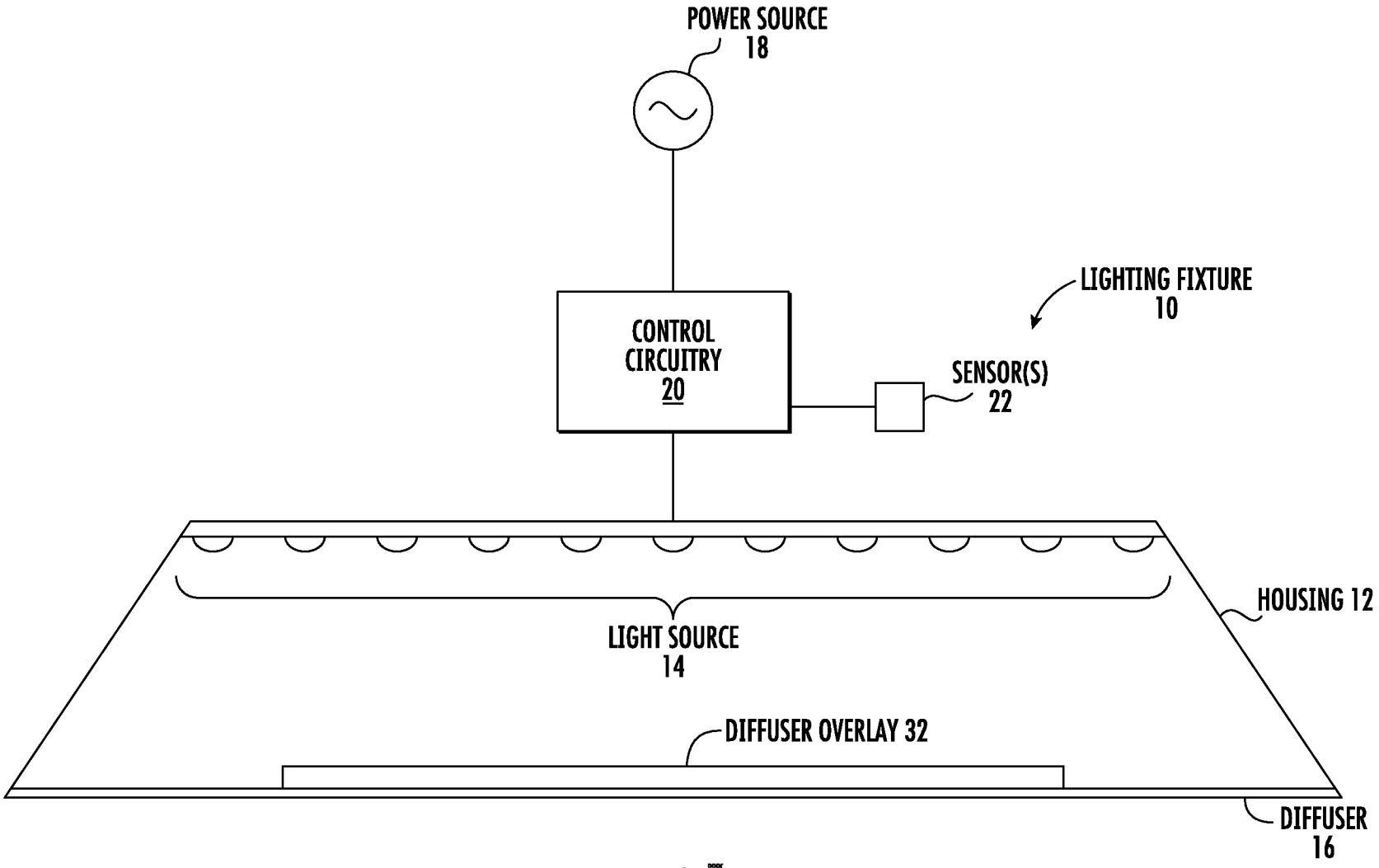
FIG. 7 illustrates a lighting fixture according to one embodiment of the present disclosure.

In some embodiments, the lighting fixture 10 may include a diffuser overlay 32 on the diffuser 16 as illustrated in FIG. 7. The diffuser overlay 32 may prevent light from the light source 14 from reaching the portion of the diffuser 16 on which the diffuser overlay 32 is provided. The diffuser overlay 32 may be provided in a desired pattern such that when the diffuser 16 is back-lit by the light source 14 the portion of the diffuser 16 on which the diffuser overlay 32 is provided appears to be a different color than the remaining portion of the diffuser 16. Notably, since the diffuser 16 is black or dark grey when it is not back-lit as discussed above, the pattern provided by the diffuser overlay 32 is not visible when the diffuser 16 is not back-lit by the light source 14. This may avoid distraction or disruption when the light source 14 is not providing light through the diffuser 16, as the pattern will not be visible. In lighting fixtures 10 such as the one shown in FIGS. 2 and 3, the lighting fixture 10 can continue to provide light for general illumination when the pattern is not visible.

Figure 8:
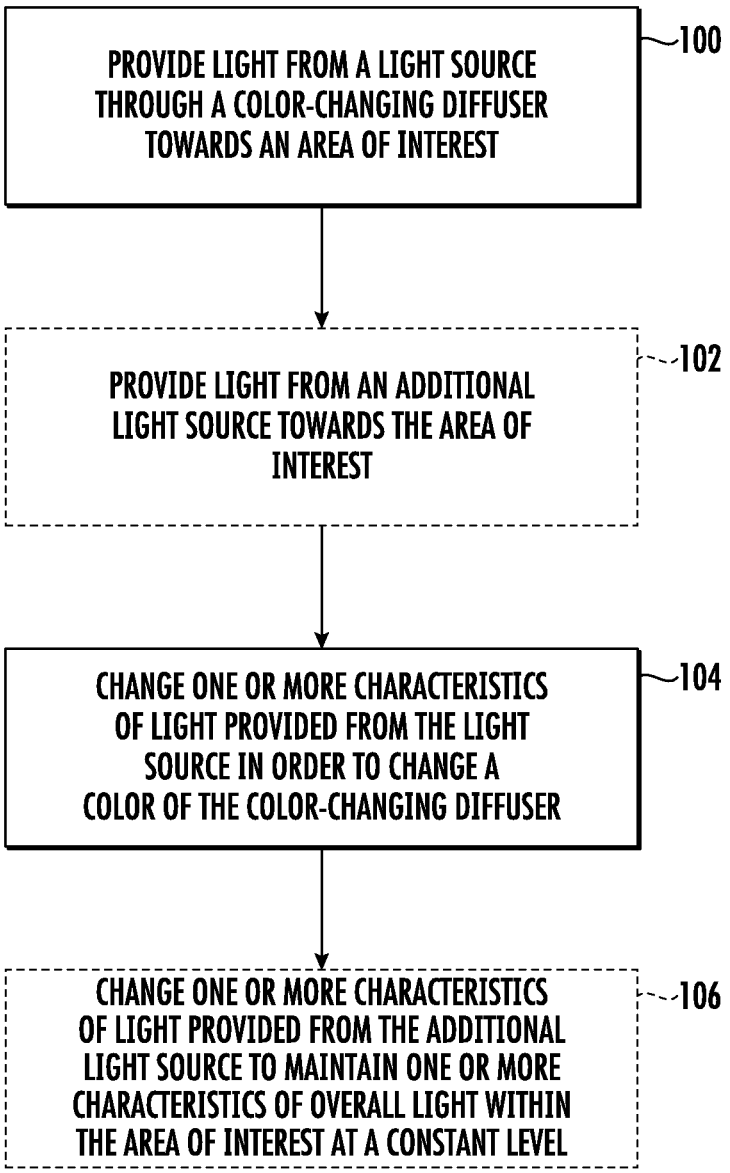
FIG. 8 is a flow diagram illustrating a method for operating a lighting fixture according to one embodiment of the present disclosure.

FIG. 8 is a flow diagram illustrating a method for operating a lighting fixture according to one embodiment of the present disclosure. The lighting fixture discussed with respect to FIG. 8 may be any of the lighting fixtures discussed above. First, light is provided from a light source through a diffuser towards an area of interest (block 100). The diffuser may comprise a color changing material as discussed above such that the diffuser appears to be a first color when primarily front-lit and appears to be a second color when primarily back-lit. In an optional step, light may be provided from an additional light source towards the area of interest (block 102). One or more characteristics of the light provided from the light source are changed in order to change a color of the diffuser (block 104). As discussed above, the color of the diffuser may be used to change the aesthetic appearance of the lighting fixture, to simulate an outdoor environment, or to convey information to individuals around the lighting fixture. In another optional step, one or more characteristics of light provided from the additional light source are changed to offset changes in the one or more characteristics of the light from the light source such that one or more characteristics of the overall light within the area of interest remain constant (block 106). As discussed above, this may involve decreasing a brightness of the light source to change a color of the color changing diffuser while increasing a brightness of the additional light source to offset the decrease in brightness of the light source. In doing so, light suitable for general illumination can be maintained and disruptions to individuals around the lighting fixture can be avoided.

As discussed above, the concepts discussed herein may be useful for communicating information via a lighting fixture while still providing light suitable for general illumination from the lighting fixture. Accordingly, individuals around the lighting fixture may not be disrupted. Any desired information can be conveyed from the lighting fixtures discussed herein. For example, binary information can be conveyed simply by changing a color of all or a portion of a diffuser as discussed above. Non-binary information may also be conveyed by changing the color of all or a portion of a diffuser in a linear or non-linear manner. Further, additional information can be conveyed when using an array of diffusers or a diffuser overlay as discussed above.

Exemplary information that may be conveyed from a lighting fixture or lighting fixtures includes information regarding the availability of a resource such as a cashier in a grocery store, a bathroom stall, a table at a restaurant, a parking spot in a parking garage, and the like, information regarding an emergency situation such as the location of an exit, the occurrence of an emergency, or the like, information related to directions within a space such as directions through a space (leading an individual to a desired location in a space by changing the color diffusers within several lighting fixtures along a desired path), controlling foot traffic (e.g., in a crowded public space such as a theme park, museum, hospital, etc.), information related to a request for services (e.g., the presence of an individual at a help desk, a flight attendant call), or any other information. In some embodiments, the information is determined by the lighting fixture 10 itself (e.g., via the control circuitry 20). The information may be determined using sensor data from the one or more sensors 22, which is processed by the control circuitry 20. In other embodiments, the information is received by the lighting fixture 10 from a remote device.

Further as discussed above, the concepts discussed herein may be useful for simulating outdoor environments with a lighting fixture. In particular, a color of a diffuser on the lighting fixture may be changed to better simulate certain outdoor environments such as overhead clouds and night skies. In various embodiments, these changes may be made in order to change the look of a lighting fixture throughout the day in order to align with circadian rhythms.

Figure 9:
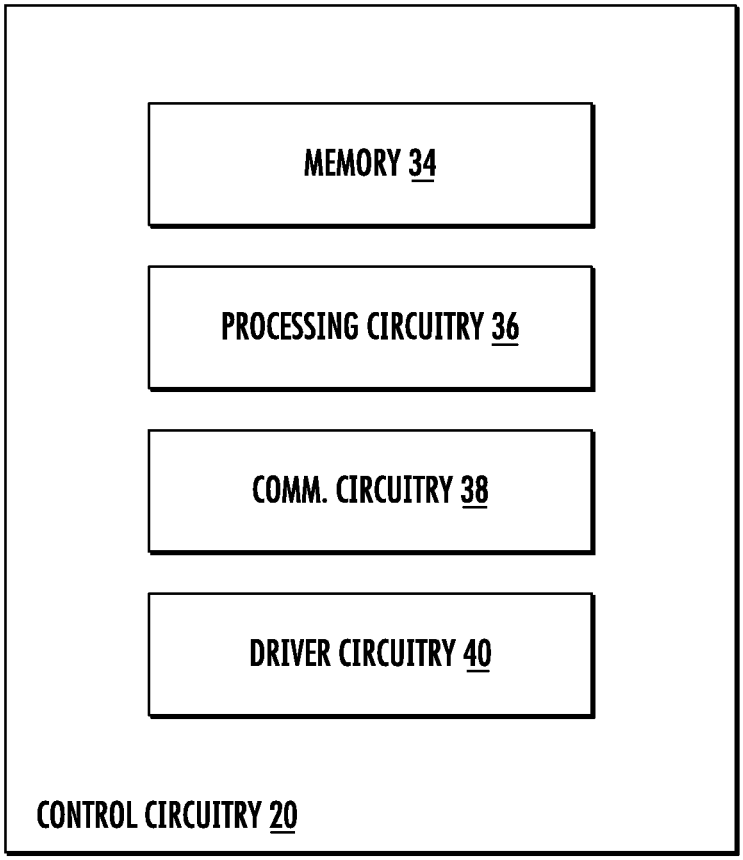
FIG. 9 illustrates control circuitry for a lighting fixture according to one embodiment of the present disclosure.

FIG. 9 shows details of the control circuitry 20 according to one embodiment of the present disclosure. The control circuitry 20 includes a memory 34, processing circuitry 36, communications circuitry 38, and driver circuitry 40. The memory 34 stores instructions, which, when executed by the processing circuitry 36 cause the lighting fixture 10 to accomplish any and all of the functionality discussed above. The communications circuitry 38 allows the lighting fixture 10 to communicate with remote devices such as other lighting fixtures, controls (e.g., wall switches and the like), and user devices (e.g., computers and portable electronic devices) in order to change one or more light output characteristics of the lighting fixture 10, change a color of one or more diffusers, or the like. The communications circuitry 38 may enable cooperation with and coordinated operation with other lighting fixtures. The driver circuitry 40 may receive power from the power source 18 and perform any necessary conversion or conditioning to provide drive signals for the light source 14 in order to control one or more light output characteristics thereof.

Those skilled in the art will recognize improvements and modifications to the preferred embodiments of the present disclosure. All such improvements and modifications are considered within the scope of the concepts disclosed herein and the claims that follow.

What is claimed is:

1. A lighting fixture comprising:

a housing;

a first light source mounted in the housing;

a second light source mounted in the housing; and a diffuser mounted in the housing such that light emitted from the first light source is provided through the diffuser towards an area of interest, wherein the diffuser is configured such that a color of the diffuser is based on one or more characteristics of the light emitted from the first light source.

2. The lighting fixture of claim 1 wherein the light emitted from the first light source is for general illumination of the area of interest.

3. The lighting fixture of claim 1 wherein the first light source comprises one or more light emitting diodes.

4. The lighting fixture of claim 1 wherein:

the diffuser comprises an array of diffusers;

the first light source comprises an array of light emitting diodes;

each one of the array of light emitting diodes corresponds to one of the array of diffusers; and light emitted from each one of the array of light emitting diodes is provided towards the area of interest through a corresponding one of the array of diffusers.

5. The lighting fixture of claim 4 wherein a color of each one of the array of diffusers is based on one or more characteristics of light emitted from a corresponding one of the array of light emitting diodes.

6. The lighting fixture of claim 5 further comprising control circuitry configured to control the one or more characteristics of the light emitted from each one of the array of light emitting diodes such that information is conveyed by an arrangement and color of the array of diffusers, wherein the information is not related to the color.

7. The lighting fixture of claim 6 wherein the information includes information about an environment surrounding the lighting fixture.

8. The lighting fixture of claim 1 further comprising control circuitry coupled to the first light source and the second light source and configured to independently adjust one or more characteristics of the light provided by the first light source and the second light source.

9. The lighting fixture of claim 8 wherein the control circuitry is further configured to adjust one or more characteristics of the light provided by the first light source to change a color of the diffuser and adjust one or more characteristics of the light provided by the second light source such that one or more characteristics of a combination of the light provided from the first light source and the light provided from the second light source remain constant.

10. The lighting fixture of claim 9 wherein the light from the second light source is provided towards the area of interest through an additional diffuser.

11. The lighting fixture of claim 1 further comprising control circuitry configured to control the one or more characteristics of the light emitted from the first light source such that information is conveyed by the color of the diffuser, wherein the information is not related to the color.

12. The lighting fixture of claim 11 wherein the information includes information about an environment surrounding the lighting fixture.

13. The lighting fixture of claim 12 wherein the control circuitry is further configured to determine the information.

14. The lighting fixture of claim 13 wherein the control circuitry is further configured to determine the information based on sensor data from one or more sensors.

15. The lighting fixture of claim 14 further comprising the one or more sensors.

16. A method for operating a lighting fixture comprising:

providing light from a first light source through a diffuser towards an area of interest, wherein a color of the diffuser is based on one or more characteristics of the light from the first light source;

providing light from a second light source; and changing the one or more characteristics of the light provided from the first light source in order to change the color of the diffuser.

17. The method of claim 16 wherein the color of the diffuser is used to convey information about an environment surrounding the lighting fixture, wherein the information is not associated with the color.

18. The method of claim 17 further comprising in response to changing the one or more characteristics of the light provided from the first light source in order to change the color of the diffuser, changing one or more characteristics of the light provided from the second light source such that one or more characteristics of a combination of the light provided from the first light source and the light provided from the second light source remain constant.

19. The method of claim 16 wherein the light provided from the first light source is for general illumination of the area of interest.

20. The method of claim 19 wherein the light provided from the second light source is for general illumination of the area of interest.

* * * * *